United States Patent [19]

McWhorter

[11] 3,974,668

[45] Aug. 17, 1976

[54] SELF SECURING THEFT PROOF CHAIN BINDER

[76] Inventor: Delmer L. McWhorter, c/o 929 Drever St., West Sacramento, Calif. 95691

[22] Filed: May 27, 1975

[21] Appl. No.: 580,570

[52] U.S. Cl. ..... 70/14; 70/19; 70/61

[51] Int. Cl.[2] ..... E05B 73/00

[58] Field of Search ..... 70/14, 15, 19, 57, 58, 70/61, 62; 211/4, 8, 60 T; 248/499, 500; 280/179 R, 179 A; 254/74, 78

[56] References Cited

UNITED STATES PATENTS

| | | | |
|---|---|---|---|
| 2,564,821 | 8/1951 | Smith | 254/78 |
| 3,071,348 | 1/1963 | Huber | 254/78 |
| 3,271,007 | 9/1966 | Ratcliff | 254/78 |
| 3,418,008 | 12/1968 | Durbin | 280/179 R |
| 3,789,464 | 2/1974 | Collanus | 254/78 |

FOREIGN PATENTS OR APPLICATIONS

| | | | |
|---|---|---|---|
| 821,566 | 11/1951 | Germany | 70/57 |

*Primary Examiner*—Robert L. Wolfe
*Attorney, Agent, or Firm*—Blair & Brown

[57] ABSTRACT

A self securing theft proof chain binder, such as would be used to tightly cinch a chain tightly holding a cargo to a truck flat bed. The binder has hooks on either of its ends to attach to the ends of the chain overlapping the cargo and the binder is pivoted in the middle so that when it has been squeezed together it tightly draws together the two ends of the chain. The lever arm on the binder has projecting spur with notch teeth therein which in turn mates with a lock on the other half of the binder so that when the two halves are squeezed together they lock in place.

5 Claims, 11 Drawing Figures

FIG. 1.
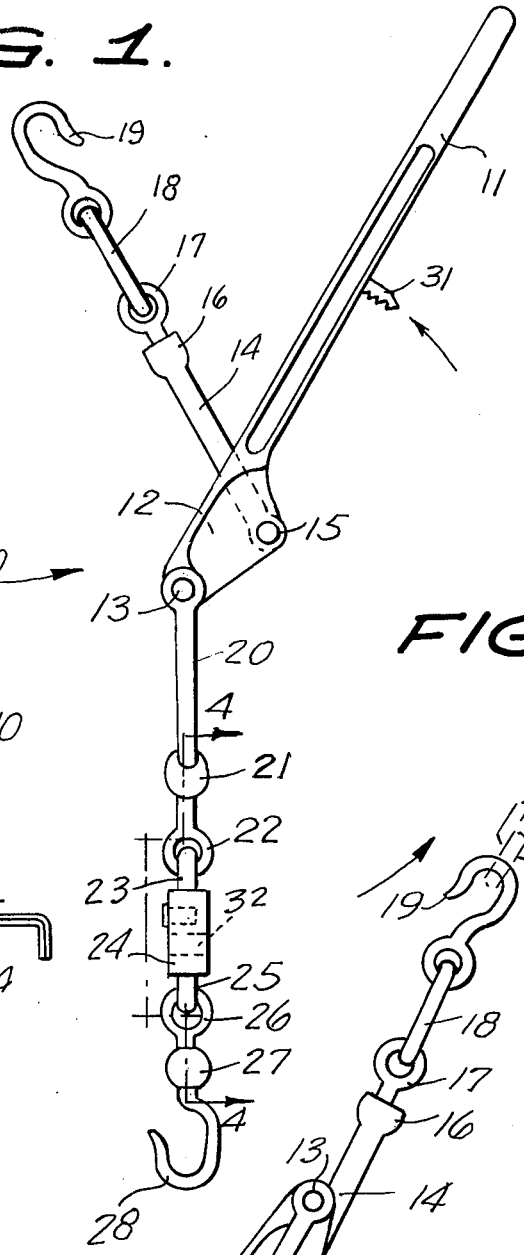
FIG. 9.
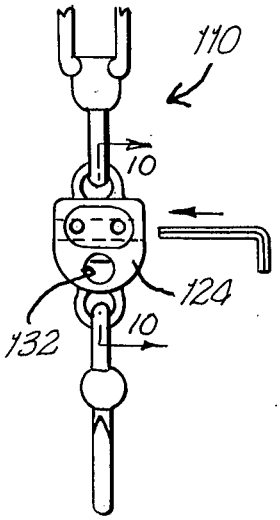
FIG. 2.
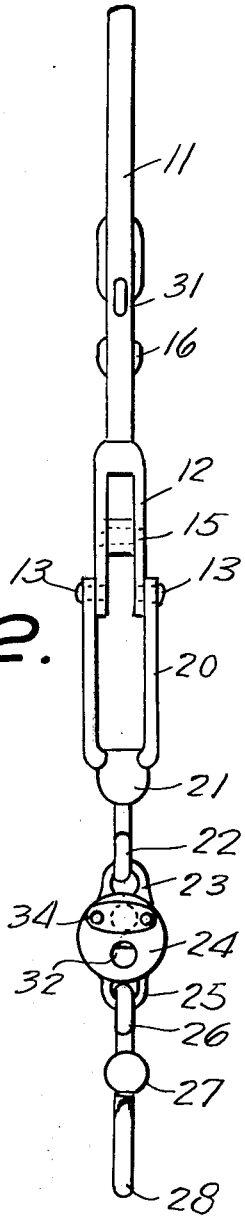
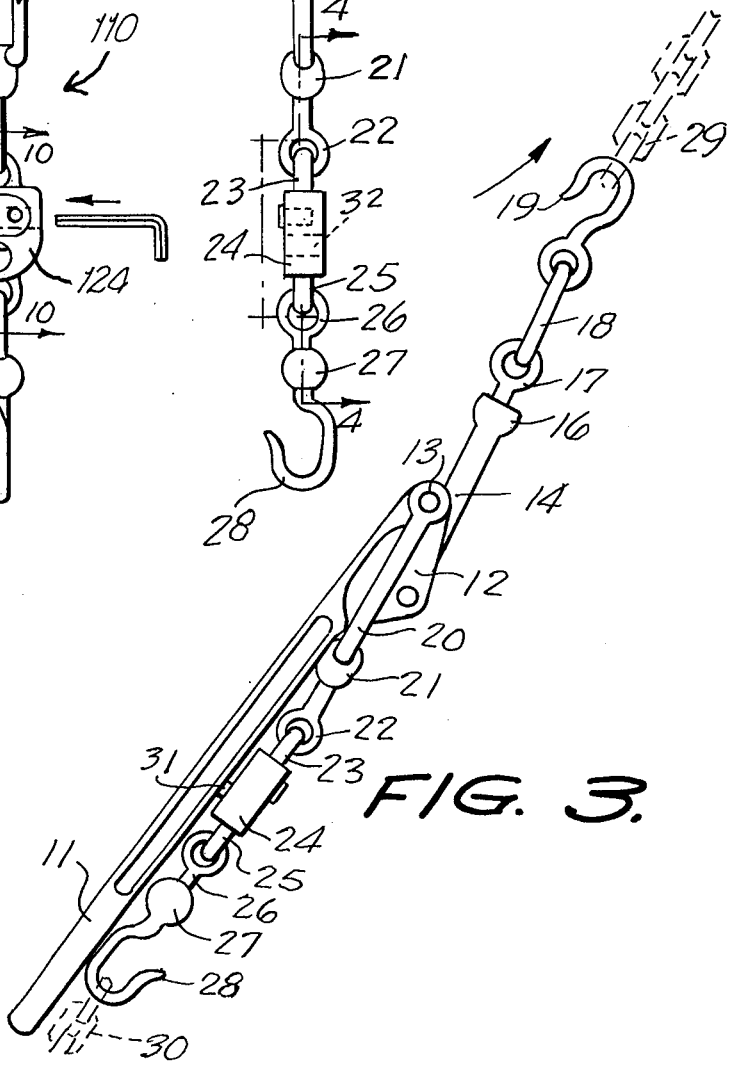
FIG. 3.

FIG. 4.
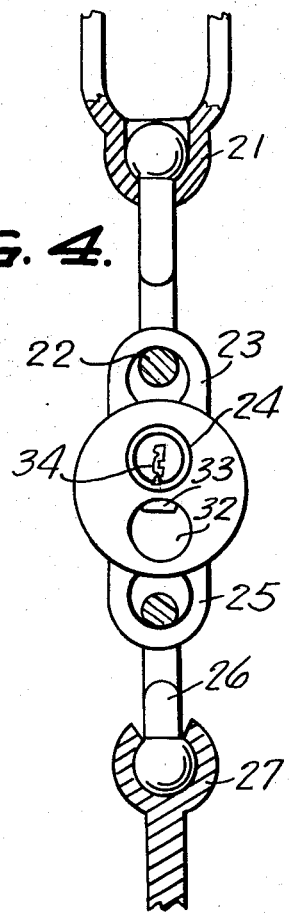
FIG. 5.
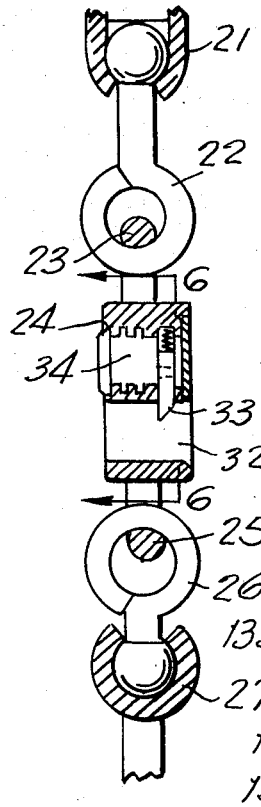
FIG. 6.
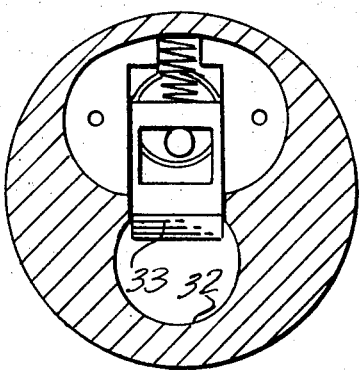
FIG. 10.
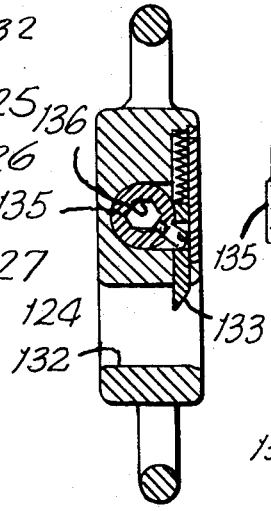
FIG. 11.
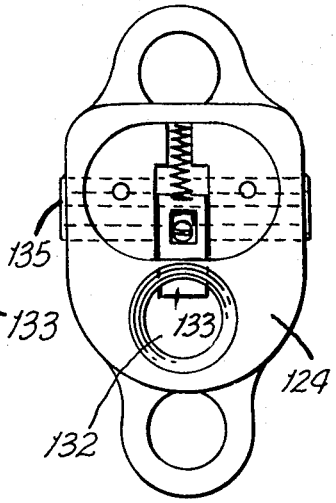
FIG. 7.
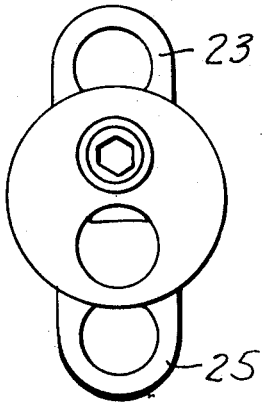
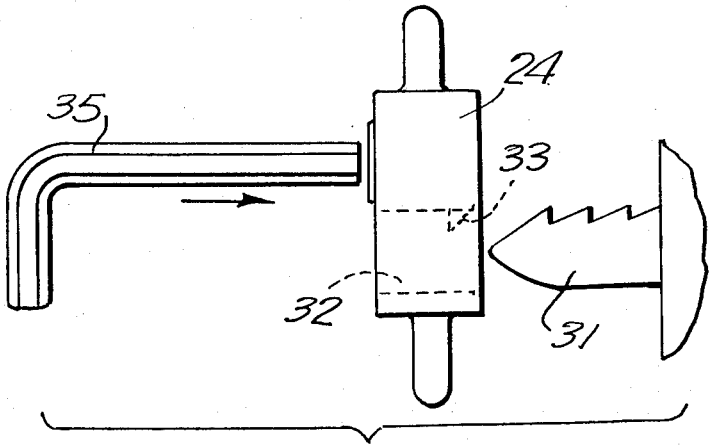
FIG. 8.

SELF SECURING THEFT PROOF CHAIN BINDER

BACKGROUND OF THE INVENTION

FIELD OF THE INVENTION

The present invention relates to self securing theft proof chain binders.

SUMMARY OF THE INVENTION

The present invention of a theft proof chain binder includes a binder having two halves hinged in the middle which is attached to the ends of a chain secured tightly over a load of merchandise secured to some form of truck bed, for example.

Typically, the ends of the chain are attached off center to the two halves of the binder so that when the halves are squeezed together there is a tightening action on the ends of the chain. The lever arm of the binder in this case has a projecting spur which is pointed at its end and has a series of notches on its under side which mate with a lock on the other half of the binder in such a manner that when the two halves are squeezed together the spur enters into a spring urged latch forming part of the lock. This automatically secures the two halves of the binder and therefore the chain cannot be arbitrarily removed. The lock can be released with a conventional key or if desired there can be used an Allen Wrench to release the spur from the binder and thereby release the chain.

The primary object of the invention is to provide a chain binder for securely cinching loads in place, said chain binder being self securing and theft proof to be released only through the use of a key.

Other objects and advantages will become apparent in the following specification when considered in light of the attached drawings.

BRIEF DESCRIPTION OF THE DRAWINGS

FIG. 1 shows an elevation view of the chain binder in an open positon;

FIG. 2 shows the chain binder in open position such as in FIG. 1 but turned through 90 degrees to be seen from the other side;

FIG. 3 shows the chain binder closed and with it locked place;

FIG. 4 shows an enlarged sectional view taken along the line 4—4 of FIG. 1, looking in the direction of the arrows;

FIG. 5 shows a view of the lock similar to FIG. 4 but turned 90°;

FIG. 6 is an enlarged sectional view taken along the line 6—6 of FIG. 5, looking in the direction of the arrows;

FIG. 7 is an enlarged view of a modified form of the lock such as would use an Allen Wrench to release it;

FIG. 8 shows the components of the lock, the spur and an Allen Wrench being inserted in the lock;

FIG. 9 is a view similar to FIG. 4 of another modified form of the invention;

FIG. 10 is a sectional view taken along the line 10—10 of FIG. 9 looking in the direction of the arrows; and FIG. 11 is a front elevation of the structure shown in FIG. 10.

DESCRIPTION OF THE PREFERRED EMBODIMENT

Referring now to the drawings in detail, wherein like references characters indicate like parts through out the several figures, the reference numeral 10 indicates generally a chain binder constructed in accordance with the invention.

The chain binder 10 comprises a lever arm 11, the inner arm of 11 terminating in a U shape plate 12 and this plate 12 is pivoted at its extremity by a pair of bolts 13. About midway of the U shape plate 12 there is a short bar 14 which is also pivoted to plate 12 as at 15.

The outer end of bar 14 terminates in a ball socket swivel connection 16, there being connected to swivel 16 an eye-bolt 17. A chain length 18 is connected through eye-bolt 17 and is used to attach an open end hook 19.

Attached by pivot bolts 13 to the lower portion of U shaped plate 12 there is another U shape fitting 20 and as shown clearly in FIG. 2 the arms of this U shape fitting 20 are large enough for receiving the U shaped plate 12 when the two parts are folded together. The lower end of fitting 20 terminates in a ball and socket swivel connection 21, swivel 21 in turn terminating in an I bolt 22.

Permanently attached to eyebolt 22 by means of a closed loop 23, there is a cylindrical lock 24, the bottom of lock 24 also having another closed loop 25 which is attached to a another eyebolt 26. A swivel 27 is utilized to connect eye bolt 26 with another open end hook 28 for attachment to the chain.

As shown clearly in FIG. 3 hook 28 is used for hook attaching to one loop 30 of one end of the chain while hook 19 may be used to attach to the end 29 of the opposite end of the chain which passes over the load.

Positioned about midway along the arm 11 of chain binder 10 there is a lock spur 31 which projects slightly from the arm of the lever 11, the lock spur being pointed at its end and having a series of notches cut in its lower side. When the chain binder 10 is closed and lever 11 has been pulled down tight, then lock spur 31 will enter a mating hole 32 in the side of cylindrical lock 34, the teeth in the side of lock spur 31 activating a spring urged latch 33, FIG. 5 and 6, to hold it in place as it enters into the lock recess.

The lock 24 may be a conventional type lock having a serrated key hole 34 for the entrance of a typical type key to release the latch 33 and thereby releasing the lock spur 31, or if desired and also for providing an additional type of security the lock may be released only by the use of an Allen Wrench 35 (see FIGS. 7 and 8) which may be inserted in its side and used to release the latch 33.

In the use and operation of the invention when the chain binder 10 is closed the lever arm 11 is pulled downward about pivot 13 to close the two halves and thereby tighten up on the hooks 28 and 19 to pull the ends of the cinched chain tight. When lever arm 11 has reached its full travel then lock spur 31 which projects from the handle 11 has mated with and aligned into hole 32 of lock 24 the serrated teeth along the edge of lock spur 31 activating and moving the latch 33 within the lock to hold the two arms together; the lock spur 31 progressively tighens notch by notch along its edges to tighten into the latch and therefore holds securely together. It should be observed that there are swivels on either end of the locks such as swivel 21 and swivel 27 so that as the lever arm 11 is moved downward then the lock 24 may be turned into these body swivels until the hole 32 in the lock aligns with the lock spur 31 so that the two will intermate. Swivels 21 and 27 serve a real purpose in the invention because as the chain binder 10 is tightened frequently it tends to twist slightly and unless these swivels are incorporated in the line of components then there may be a problem in having the lock spur 31 aligned with the hole 32 in the lock 24.

In FIGS. 9, 10 and 11 a modified form of the invention is illustrated at 110. The change binder 110 includes a lock 124 which replaces the lock 24. The lock 124 has a mating hole 132 in to which a spring urged latch 133 projects to engage the lock spur 31. A cylinder 135 extends transversely of the lock 124 and has a hexagonal opening 136 extending completely therethrough to receive an Allen Wrench to turn the cylinder 135 so as to retract the spring urge latch 133. The form of the invention illustrated in FIGS. 9, 10 and 11 differs from that of the other forms of the invention in that the lock cylinders 135 open to the sides to be readily available for release even if the lock 124 is tightly engaged against a load on its rear side. In some uses of the chain binder the lock 24 would be tightly engaged to the load making the key way unaccessible while in other forms of its use it would be free of the load and readily accessible. The forms of the invention illustrated in FIGS. 1 through 11 will permit the use of the chain binder regardless of the type of load with which it is to be used.

Having thus described the preferred embodiment of the invention it should be understood that numerous structural modifications and adaptations may be resorted to without departing from the spirit of the invention.

What is claimed is:

1. A self securing theft proof chain binder comprising a lever arm; a fitting at the inner end of the lever arm; a chain hook attached to the fitting; a first swivel attached to the fitting; a lock attached to the first swivel; a second swivel connected to the lock; another chain hook attached to the second swivel and means forming part of the lever arm for mating with the lock.

2. The device of claim 1 wherein the means for mating with the lock is a spur extension with notches along its length.

3. The device of claim 2 wherein the lock has a passage therethrough for receiving the spur extension and the notches on the spur extension are held by a latch within the lock.

4. The device of claim 3 wherein the chain hook and the first swivel are pivotally attached to the fitting on the end of lever arm.

5. The device of claim 4 wherein the first and second swivels permit rotation of the lock so that the passage through the lock may be aligned to receive the spur extension when the chain binder is closed.

* * * * *